United States Patent [19]

Overholt

[11] 4,270,788

[45] Jun. 2, 1981

[54] BAG HOLDING DEVICE

[76] Inventor: Ronald Overholt, 220 Winding Way, Morrisville, Pa. 19067

[21] Appl. No.: 129,008

[22] Filed: Mar. 10, 1980

[51] Int. Cl.[3] ..... A47F 13/08

[52] U.S. Cl. ..... 294/55; 294/19 R

[58] Field of Search ..... 294/55, 19 R, 1 R, 51, 294/52, 57, 59; 15/257.1, 257.4, 257.5, 257.8; 248/99, 101; 56/400.09, 400.21, 400.14, 400.15

[56] References Cited

U.S. PATENT DOCUMENTS

| | | | |
|---|---|---|---|
| 3,688,483 | 9/1972 | Hamilton | 56/400.11 |
| 3,711,141 | 1/1973 | Soergel | 294/55 |
| 3,754,785 | 8/1973 | Anderson | 294/19 R |
| 3,893,649 | 7/1975 | Cornell et al. | 248/99 |
| 3,942,832 | 3/1976 | Haas, Jr. | 294/55 |
| 4,048,691 | 9/1977 | Spangler | 15/257.1 |
| 4,159,139 | 6/1979 | Gawedzinski | 294/55 |

*Primary Examiner*—James B. Marbert

*Attorney, Agent, or Firm*—John J. Kane; Frederick A. Zoda; Albert Sperry

[57] ABSTRACT

A bag holding device particularly designed for holding in an open position a trash bag or similar type of receptacle such that it is capable of receiving easily large amounts of trash such as leaves or year debris. The device includes a generally loop-shaped frame having a flexible member secured along the frame. The flexible member is adapted to form a loop of bag material as the bag is placed over the frame such that when a retaining means is moved downwardly on to the frame to hold the bag in place secured thereto, the loop of bag material formed by the flexible member will allow the retaining device to secure the bag in place without damaging the bag material itself. This is achieved by making the flexible device collapsable to allow the loop to close as the retaining member is placed downwardly on to the frame.

11 Claims, 6 Drawing Figures

BAG HOLDING DEVICE

BACKGROUND OF THE INVENTION

1. Field of the Invention

The present invention relates to the field of devices usable for the holding of bags or other similar receptacles in an open position. Such designs are particularly usable for containing yard debris such as leaves and the like and the present invention provides a design which is particularly usable as a mechanism for securing plastic leaf bags to a tubular frame to allow for quick removal of leaves from the raked location.

2. Description of the Prior Art

Many designs have been shown or suggested for the purpose of holding bags in an open position for yard clean-up operations. Most of these devices have provided a means in which the plastic bag opening is expanded to the open position to facilitate filling of the bag with yard debris and leaves. Particularly these designs do not provide a secure locking mechanism which holds the bag in place during the movement around the yard from one location to another. Furthermore, these designs have been found to stretch the rim of the plastic bags thereby distorting and weakening the bag. The devices do not provide the capability of holding a plastic bag securely around their perimeter to accommodate the heavy loads and large volumes to which uses they are put. Many of such devices are similar, however, the additional lever involved with moving the device and setting it up at different locations makes usage unduly burdensome. One of the main problems is the lack of capability for securing the fastening of the rim of the bag to the device for transporting the bag after it has been filled with a heavy load.

Examples of patents which show designs of a similar nature are U.S. Pat. Nos. 4,149,139, 3,754,785, 3,688,483, 3,711,141, and 4,048,691. None of these designs, however, shows the novel interlocking structure of the present design wherein a loop is formed during placement.

SUMMARY OF THE INVENTION

The present invention provides a device for the holding of bags or other receptacles in an open position wherein damaging of the bags during usage is minimized. This bag holding device preferably includes a frame of a generally loop-shaped, rectangularly formed configuration which is adapted to receive the open end of the bag thereover and hold the bag in an open position. To facilitate in this holding the frame should include preferably a convex arcuate gripping surface and also preferably tubular and of an approximately circular cross-section.

A handle member is fixedly secured to the frame means to extend outwardly therefrom and facilitate the holding of the open bag in the desired orientation. Also fixedly secured to the frame around at least a portion thereof is a flexible means. This flexible means is preferably secured to a slot defined along one surface of the frame in the middle of the gripping surface. The flexible means preferably includes a body member which itself is fixedly secured into the slot as well as a head means pivotally secured with respect to the body member to be compressible thereagainst responsive to a force being exerted against the head member downwardly in a direction toward the body and toward the frame. This force is normally exerted by the bag itself during locking of the bag by a retaining means later described. The flexible device itself should be adapted to resiliently flex inwardly toward the gripping surface responsive to this downward pressure being exerted by the bag and when the bag is removed to resiliently assume the original position protruding outwardly from the gripping surface. A retaining means should be detachably securable with respect to the frame means along the gripping surface thereof to selectively retain the bag in an open orientation extending over the flexible device. For this purpose, the retaining means should include an arcuate gripping means which is adapted to abut the gripping surface during placement thereof such as to pull the bag along the gripping surface in opposite directions to compress the flexible means inwardly toward the frame by the similarly inwardly directed force exerted against the bag. In other words, as the bag is placed on to the frame, the flexible means forms a loop of bag material which is compressed by downward pressure on the bag during placement of the retaining means on the flexible device. In this manner the loop is compressed and the flexible member is pivoted downwardly to thereby make a firm securement between the bag holding device of the present invention and the bag itself without stretching or stressing the bag material and causing rupture thereof.

The retaining means may further include a locking enclosure or chamber therein which is adapted to compress by abutting the flexible device when the retaining means has been fully placed over the frame means in the fully interlocked position such as to form a complete securement of the retaining means with respect to the frame to facilitate the pressure used for holding the bag in position, especially usable when the bag is under heavy load.

In order to facilitate interlocking between the retaining device and the flexible member, it is preferable to form the gripping surface of the frame member in a convex, arcuate fashion and to form the gripping means of the retaining member in a concave arcuate manner. Also, it is preferably that the arcuate surface of the gripping means have a smaller radius curvature than the gripping surface in order to facilitate holding of the retaining means on the frame means. In other words, the retaining means with this configuration will be able to snap around the larger and rounded tubular frame means to thereby lock itself in place and hold the bag in place. Also, as the retaining means is placed into position it will draw the bag downward on both sides of the tubular frame means and compress the flexible member into a fixed position of securement. To further ease placement of the retaining means an outwardly extending ear may extend on each concave arcuate surface thereof to more easily allow placement of the retaining means around the frame means.

It is an object of the present invention to provide a holding device for the retaining of a bag in an open position.

It is an object of the present invention to provide a bag holding device particularly usable for holding a trash bag in an open position for the receiving of leaves and other yard debris therein.

It is an object of the present invention to provide a bag holding device for holding of receptacles in an open position which minimizes damaging of the bag during locking of the bag to the bag holding device.

It is an object of the present invention to provide a bag holding device particularly usable for holding bags in an open position which is of minimum weight to facilitate portability thereof.

It is an object of the present invention to provide a bag holding device which is particularly usable for holding a bag in an open position which is inexpensive to manufacture and market.

It is an object of the present invention to provide a bag holding device which is usable for the holding of a bag in an open position which includes a minimum amount of maintenance by providing a minimal number of moving parts.

It is an object of the present invention to provide a bag holding device which is particularly usable for holding trash bags in an open position which includes a secure locking mechanism attached to a tubular frame that will prevent tearing or distortion of a plastic bag during installation.

It is an object of the present invention to provide a bag holding device which includes a locking means which securely holds a rim of a plastic bag in place in a rectangular looped orientation to thereby facilitate loading and transporting under heavy loads.

It is an object of the present invention to provide a bag holding device for holding a leaf bag in an open position to facilitate the maximal usage of trash bags wherein they are filled to maximum capacity.

It is an object of the present invention to provide a bag holding device including a positive locking feature which purposely forms a loop for preventing tearing, ripping or stretching of the bag during locking in place and yet which provides a firm means of attachment of the bag to a tubular device which holds it in an open position.

It is an object of the present invention to provide a bag holding device which minimizes the amount of bending over needed by an operator during usage in the collecting of trash and other yard debris.

It is an object of the present invention to provide a secure locking device for usage with a bag holding device which enables the operator to expel air from within the bag and thereby to accommodate a larger amount of material merely by flipping the bag and allowing it to flow under the loop toward the front of the device.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1A:
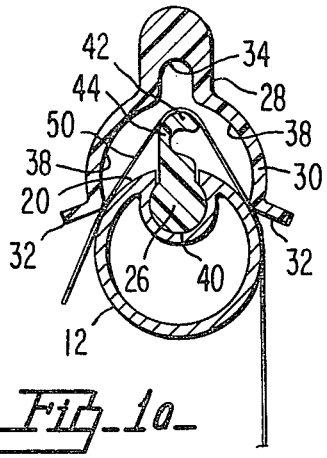
FIGS. 1*a*–1*c* are cross sectional views of an embodiment of the interlocking configuration of the bag holding device of the present invention as shown in various positions of placement.

The present invention provides a bag holding device 10 which includes a frame means 12 having a generally rectangular loop-shaped configuration 22. This configuration is proven to be the most efficient in usage particularly for cleaning of yard debris such as leaves and the like, however, any particular overall shape can be used. A handle means 14 is detachably securable with respect to the frame 12 in order to allow the user to hold the device 10 from a standing location. The bag 16 should preferably be maintained in an open position 18 by securement around the periphery of the frame means 12.

Frame means 12 preferably includes a gripping surface 20 which is adapted to hold the peripheral edge of bag 16 in position. This holding is achieved by a biasing against the gripping surface 20 exerted by a retaining means 28. The retaining means 28 may preferably include three individual retaining members 48 each of which include a gripping means 30 adapted to directly bias the bag against a gripping surface 20 defined on the frame means 12.

Figure 2:
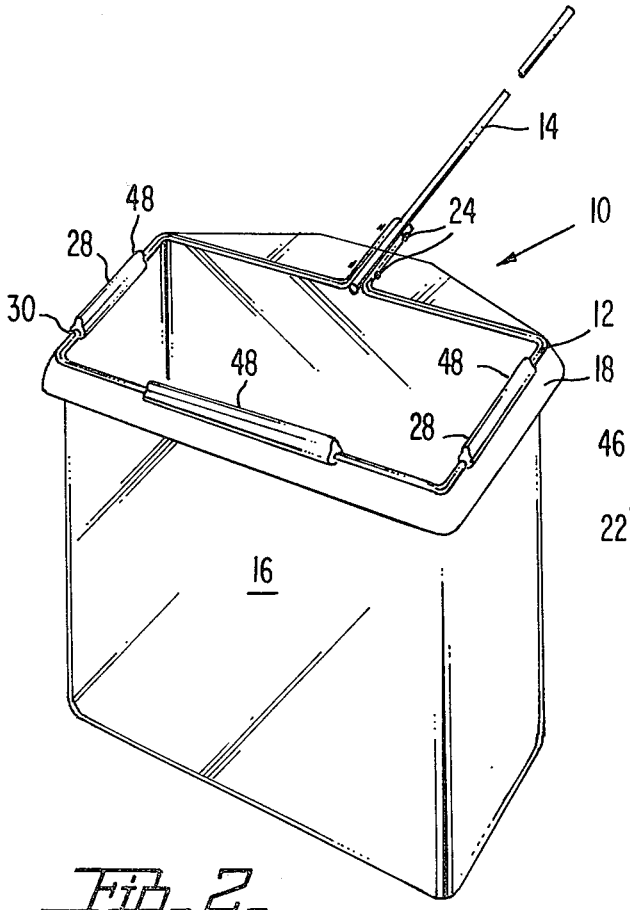
FIG. 2 is a perspective view of an embodiment of the bag holding device of the present invention shown with a bag in place.
Figure 3:
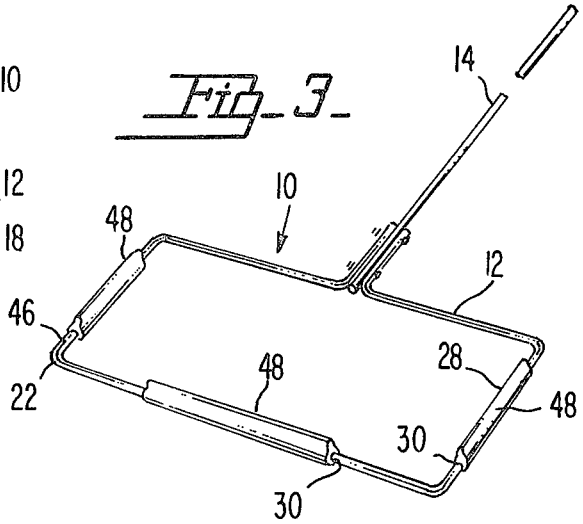
FIG. 3 is an illustration of the embodiment shown in FIG. 2 without the bag in place.
Figure 4:
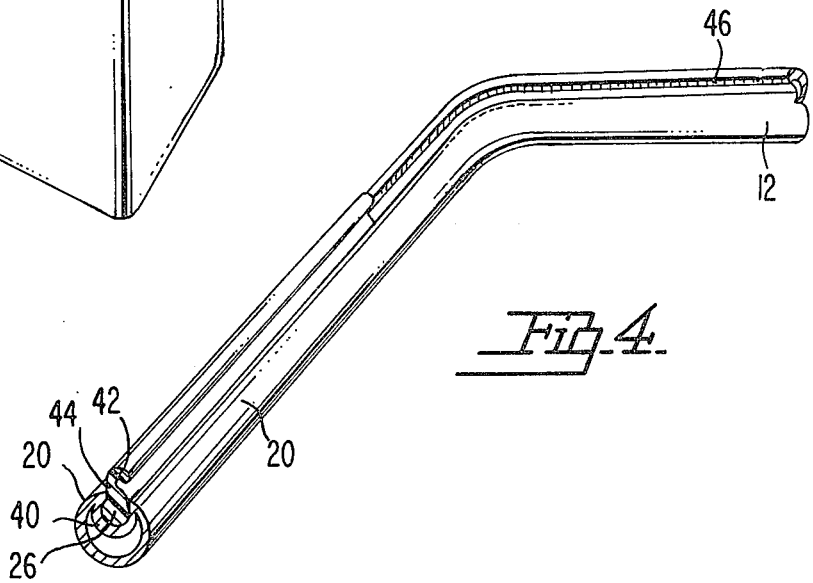
FIG. 4 is a perspective view of an embodiment of one side of the loop of the frame of an embodiment of the bag holding device of the present invention.

In order to prevent damaging of the bag 16 during securement to the frame 12 by the retaining means 28, a flexible means 26 is preferably fixedly secured to the frame along at least a portion thereof. It is preferable to affix this flexible means 26 into a slot means 46 defined by the frame means along one surface thereof. The flexible means 26 extends, as shown in FIGS. 2 and 4, upwardly along at least a portion of the slot 46 to thereby force a loop of bag material as best shown in FIG. 1*a* to be formed when the bag is placed over the gripping surface 20. Then as the retaining means 28 is pushed into position, the flexible means 26 will be compressed and the bag will be retained in position. When the bag is in the fully retained position a locking enclosure 34 defined by the retaining means 28 will completely compress the flexible means 26.

To facilitate cooperating interaction of the members of the present design, and to firmly lock the bag 16 in place without tearing thereof, it is desirable to form the gripping surface 20 of the frame means 12 in a convex arcuate configuration 36. This configuration normally results from the choice of the frame means 12 to be tubular or at least round. Also, to compliment this convex arcuate surface 36, a concave arcuate surface 38 is normally the chosen configuration for the gripping means 30 defined by the retaining means 28. To assure a firm interlocking between the convex arcuate surface 36 and the concave arcuate surface 38 it is preferable that the radius curvature of the outer or concave arcuate surface 38 be of a slightly smaller diameter than the radius of curvature of the convex arcuate section 36.

The configuration of the flexible means 26 preferably includes a body member 40 which is adapted to be directly positioned into the slot means 46. The flexible means 26 should also include a head means 42 which should be connected to the body member 40 by way of a pivot means 44. In this manner as the flexible means 26 is compressed downwardly the head means 42 will pivot toward the body member 40 via the pivot means 44. In this manner the bag loop 40 will be compressed while the retaining means 28 is being urged in the placement direction 52.

To further facilitate movement of the retaining means 26, into position over the frame means 12, a plurality of ear means 32 may be included extending outwardly adjacent to the gripping means 30. Furthermore, to facilitate interconnection between the handle means 14 and the frame means 12 a bolt attachment means 24 as shown in FIG. 2 may be utilized.

In operation the present design starts by the placement of a bag 16 over the upper edge of a generally loop-shaped frame 12. This frame includes a slot 46 which includes therein a flexible means 26. This means 26 is compressible in a downward direction and is resilient to return to the upwardly extending position after removal of the bag.

In usage the bag 16 is placed over the frame means 12 and the flexible means 26. Then the one or more retaining means 28 are pushed into position by movement in the placement direction 52. This movement is best shown in three stages as in FIGS. 1*a*, 1*b*, and 1*c*.

Figure 1B:
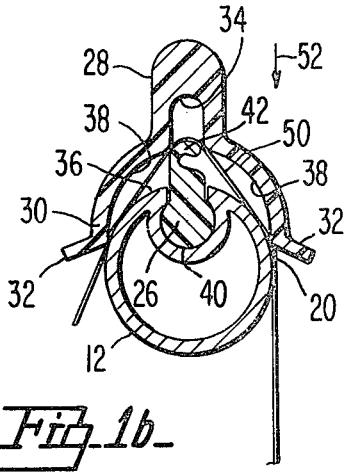
Figure 1C:
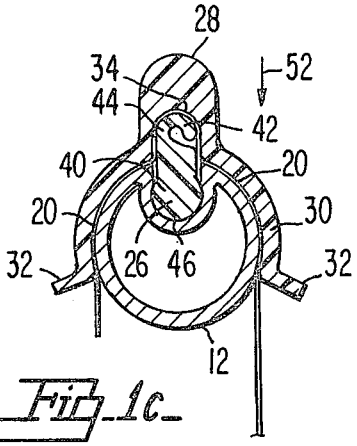

In FIG. 1*a* we see the bag having been placed over the frame 12 and the retaining means 28 initially starting to be placed downward over the frame. Initially on contact of the gripping means 30 of the retaining means 28 with the gripping surface 20 of the frame means 12, the bag will be locked therebetween. By further movement downward as shown in FIG. 1*b* the bag will be stretched on either opposite side of the generally tubular frame which will cause a downwardly exerting bias on the flexible means 26 and in particular upon the head means 42 thereof. Pivoting about the pivot means 44 will be created and the bag loop 50 which was initially formed about the flexible means 26 will start to be compressed. When the retaining means is in the fully inserted position as shown in FIG. 1*c* the bag will have completely compressed the flexible means 26 by urging the head means 42 downwardly toward the body member 40 and a locking enclosure 34 defined in the retaining means 28 will further lock the overall configuration in place. In this manner as the bag is pulled downwardly, the bag itself will not be stretched but instead the flexible means 26 will be flexed downwardly. Therefore, as the bag is pulled down on each opposite side of the tubular frame 12 there will be no distortion of the bag material itself. This will be seen from a close viewing of FIGS. 1*a*, 1*b*, and 1*c* by noting the compression of both bag loop 50 and flexible means 26. In this manner the present invention provides an overall design which fixedly secures a bag in place with respect to a bag holding device without distortion, ripping or tearing of the bag itself by the forced formation of a loop prior to placement of the gripping device against the frame which holds the bag in the open position. While three such retaining means 28 are shown in the present invention certainly any number of retaining means can be used or a single large loop-shaped configuration may be used.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A bag holding device, for holding a bag in an open position, which comprises:

(a) a frame means in a generally loop-shaped configuration including a gripping surface adapted to receive and hold the opening of a bag thereover and hold the bag in an open position;

(b) a handle means attached with respect to said frame means and extending outward therefrom to facilitate holding of the open bag in the desired orientation;

(c) a flexible means secured along at least a portion of said gripping surface of said frame means and protruding outwardly therefrom, said flexible means adapted to resiliently flex inwardly toward said gripping surface responsive to a bag being pulled downwardly thereover and responsive to resiliently reflex to a position protruding outwardly from said gripping surface when the bag is removed therefrom; and (d) a retaining means being detachably securable with respect to said frame means along said gripping surface thereof to selectively retain the bag in an open orientation extending over said flexible means, said retaining means including a gripping means adapted to abut said gripping surface during securement with respect thereto to pull the bag along said gripping surface in opposite directions to compress said flexible means inwardly toward said frame means by similar inwardly directed force exerted thereagainst by the bag.

2. The device as defined in claim 1 wherein said retaining means further includes a locking enclosure adapted to fully compress said flexible means responsive to complete securement of said retaining means with respect to said frame means to facilitate attachment of the bag with respect to said frame means.

3. The device as defined in claim 1 wherein said gripping surface is convex arcuate and said gripping means is concave arcuate having a smaller radius of curvature than said gripping surface to facilitate holding of said retaining means on said frame means.

4. The device as defined in claim 3 wherein said retaining means includes outwardly extending ear means adjacent said gripping means to facilitate ease of placement of said gripping means over said gripping surface.

5. The device as defined in claim 1 wherein said flexible means comprises:

(a) a body member fixedly secured with respect to said frame means;

(b) a head means pivotally secured with respect to said body member to be compressable thereagainst responsive to a force exerted against said head member in a direction toward said body member and toward said frame means; and (c) a pivot means interconnecting said head means and said body member to allow relative movement therebetween responsive to inward pressure exerted against said head means by the bag.

6. The device as defined in claim 5 wherein said frame means defines a slot means therein adapted to receive and fixedly secure said body member therein.

7. The device as defined in claim 1 wherein said frame means defines a slot means therein adapted to receive and fixedly secure said flexible means therein.

8. The device as defined in claim 1 wherein said retaining means includes three retaining members detachably securable around said frame means at spaced positions therealong to facilitate holding of the bag in an open position.

9. The device as defined in claim 1 wherein said frame means is of a generally rectangular loop-shaped configuration with rounded corners to facilitate holding of the bag in an open position.

10. The device as defined in claim 1 wherein said frame means is tubular.

11. A bag holding device, for holding a bag in an open position which comprises:

(a) a frame means in a generally rectangular loop-shaped configuration including an arcuate gripping surface adapted to receive and hold the opening of a bag thereover and hold the bag in an open position, said frame means further defining a slot means therein;

(b) a handle means attached with respect to said frame means and extending outwardly therefrom to facilitate holding of the open bag in the desired orientation;

(c) a flexible means secured along at least a portion of said gripping surface of said frame means and protruding outwardly therefrom, said flexible means being directly secured into said slot means of said frame means, said flexible means adapted to resiliently flex inwardly towards said gripping surface responsive to a bag being pulled downwardly thereover and responsive to resiliently reflex to a position protruding outwardly from said gripping surface when the bag is removed therefrom, said flexible means further comprising a body member fixedly secured with respect to said frame means, a head means pivotally secured with respect to said body member to be compressible thereagainst responsive to a force exerted against said head member in a direction toward said body member and toward said frame means and the pivot means interconnecting said head means to said body member to allow relative movement therebetween responsive to inward pressure exerted against said head means by the bag; and (d) a retaining means being detachably securable with respect to said frame means along said gripping surface thereof to selectively retain the bag in an open orientation extending over said flexible means, said retaining means including an arcuate gripping means adapted to abut said gripping surface during securement with respect thereto to pull the bag along said gripping surface in opposite directions to compress said flexible means inwardly toward said frame means by the similarly inwardly directed force exerted thereagainst by the bag, the radius of curvature of the gripping means being less than the radius of curvature of the gripping surface to facilitate holding of said frame means by said retaining means, said retaining means further including a locking enclosure adapted to fully compress said flexible means responsive to complete securement of said retaining means with respect to said frame means to facilitate attachment of the bag with respect to said frame means, said retaining means further including outwardly extending ear means adjacent said gripping means to facilitate ease of placement of said gripping means over said gripping surface.

* * * * *